US011740060B2

(12) United States Patent
Forrest

(10) Patent No.: US 11,740,060 B2
(45) Date of Patent: Aug. 29, 2023

(54) ARROW SYSTEM

(71) Applicant: Richard M. Forrest, Vail, AZ (US)

(72) Inventor: Richard M. Forrest, Vail, AZ (US)

( * ) Notice: Subject to any disclaimer, the term of this patent is extended or adjusted under 35 U.S.C. 154(b) by 0 days.

(21) Appl. No.: 17/647,250

(22) Filed: Jan. 6, 2022

(65) Prior Publication Data

US 2023/0213319 A1 Jul. 6, 2023

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 3,401,938 A * 9/1968 Bear ..... F42B 6/08 473/582
3,910,579 A * 10/1975 Sprandel ..... F42B 6/08 473/584
4,029,319 A 6/1977 Christen
4,141,554 A * 2/1979 Sherwin ..... F42B 6/06 473/585
4,175,749 A * 11/1979 Simo ..... F42B 6/08 473/584
4,210,330 A 7/1980 Kosbab
4,468,038 A 8/1984 Saunders
4,943,067 A 7/1990 Saunders
5,478,089 A 12/1995 Austin
5,482,294 A 1/1996 Sullivan et al.
5,496,043 A 3/1996 Ester
5,611,542 A 3/1997 Saunders
6,623,385 B1 9/2003 Cole et al.
6,726,581 B2 4/2004 Muller
6,821,221 B2 11/2004 Derus et al.
7,318,783 B2 1/2008 Polando
D672,836 S 12/2012 Butcher
8,337,342 B1 12/2012 Huang
8,480,520 B2 7/2013 Webber et al.
8,529,385 B1 9/2013 Lee
9,410,773 B2 8/2016 Greenwood
9,638,499 B2 5/2017 Perry
10,809,044 B2 10/2020 Perry
10,859,354 B1 12/2020 Huang
11,022,413 B1 6/2021 Broderick
(Continued)

OTHER PUBLICATIONS

R.O.C. System. Bloodsportarchery.com. (n.d.). Retrieved Jan. 6, 2022, from https://www.bloodsportarchery.com/technology.
(Continued)

*Primary Examiner* — John A Ricci
(74) *Attorney, Agent, or Firm* — Dunlap Bennett & Ludwig, PLLC

(57) ABSTRACT

A arrow system embodying a glue-in configuration or screw-over configuration of broadhead to arrow shaft connection is provided. The glue-in configuration provides an externally threadless broadhead shank for slidably reception into the complementary and cross-sectionally coextensive lumen of the arrow shaft. The screw-over configuration provides a broadhead with female internal threading that operatively associates with male threading of an insert that interconnects the broadhead to the lumen of the arrow shaft.

2 Claims, 11 Drawing Sheets

(56) References Cited

U.S. PATENT DOCUMENTS

| | | | | |
|---|---|---|---|---|
| 11,098,994 | B1 | 8/2021 | Huang | |
| 2005/0072413 | A1* | 4/2005 | Palomaki | F42B 6/08 124/1 |
| 2005/0075203 | A1* | 4/2005 | Palomaki | F42B 6/04 473/578 |
| 2007/0082767 | A1* | 4/2007 | Smith | F42B 6/08 473/582 |
| 2008/0176681 | A1* | 7/2008 | Donahoe | F41B 5/1403 73/488 |
| 2019/0265007 | A1 | 8/2019 | Gizowski et al. | |

OTHER PUBLICATIONS

FAQs—The Centerpin System. Valkyrie Archery, (n.d.). Retrieved Jan. 6, 2022, from https://valkyriearchery.com/shop/deathswitch-broadheads/ https://valkyriearchery.com/faqs/#1620412764394 0cec8069-ebe5.

* cited by examiner

ARROW SYSTEM

BACKGROUND OF THE INVENTION

The present invention relates to arrow systems and more particularly, to arrow systems that improve the concentricity between the broadhead and the arrow shaft centerline, while enabling selective configurability of the spine stiffness, the front of center balance of the arrow, and clocking of broadhead blade configurations.

In archery, front of center balance (FOCB) describes the percentage of the arrow's total weight located in the front half of the arrow, wherein the more weight located in the front half of the arrow, the more "forward" the FOCB. The FOCB of the arrow affects its stability and the shape of the arrow's trajectory curve with the lower the FOCB the more erratic the flight. To wit, the Archery Manufacturers Organization (AMO) has created a set of standards for arrows, including the AMO-standard FOCB formula of $(100\times(A-L/2))/L$ for fine tuning the FOCB. Therefore, adding weight to either the front or the rear of the shaft can modify the FOCB.

Another factor in the accuracy of an arrow is its spine stiffness. If an arrow is too stiff or not stiff enough ("under-spined") the arrow will kick to the left or the right, respectively. Spine wall thickness and the weight of the spine are two important aspects in determining spine stiffness, and thus adding weight enables an archer to selectively adjust the spine stiffness of their arrow.

Current arrow setups include a screw-in broadhead having male threads for screwing the broadhead into the female threads of an arrow shaft insert or a collar ("outsert") interconnecting the broadhead and the arrow shaft. In the prior art, these outserts or inserts may be glued on (e.g., over the outer circumference of) or glued into (e.g., into the inner circumference of) the arrow shaft, respectively.

Understanding the manufacture process of current arrows helps explain the problems inherent in the prior art, specifically for micro-diameter arrows. In the assembly of an arrow, different manufacturers are involved in making the different components (broadhead, outsert/insert, arrow shaft), and not infrequently, there are multiple manufactures involved for the various subcomponents of one component. And each component may have different AMO standards. Also each manufacturer/machine shop may have different tolerances so that when combining two or more components from different manufacturers, there is a likelihood of intolerances between connected components.

Most notably in the prior art, the broadhead shank has male threading which screws into female threading of the arrow shaft or a collar (of the arrow shaft). In the field of micro-diameter arrows, the male threading increases the perimetral boundary of the broadhead shank to the point where it no longer can fit inside the micro-diameter of the arrow shaft, and thus male threaded broadhead shanks demands a collar outsert. A micro-diameter arrow is generally defined as an arrow shaft having anything less than 0.250" inner diameter, and as a result, the standard AMO insert no longer fits inside the arrow shaft.

The collar outsert is by definition larger than the arrow shaft, which may detrimentally alter the micro-diameter arrow's spine stiffness and introduce eccentricity and other instabilities. Furthermore, the male threading has an end point and overall length which, as mentioned above, may vary from manufacturer to manufacturer. These two variables, if different between arrows, is what could require an archer to have to vary their clocking from arrow to arrow.

Finally, imperfect mating of threading can cause suboptimal fitness. In short, the more components the more likely the resulting amalgamated arrow is to be eccentric.

To be sure, these intolerances and eccentricities may be, at least partially, accounted for and rectified by the end user through making certain accuracy adjustments. These accuracy adjustments may include the following: modifying the FOCB; radially re-orienting of the broadhead blades relative to the arrow shaft vanes ("clocking"); and changing the shaft stiffness. These accuracy adjustments can recalibrate the stability, trajectory, and thus accuracy of the arrow. However, the more component interconnections (points of intolerance) the less likely an archer can count on a specific clocking to be repeatedly satisfactory from arrow to arrow. Importantly, the arrangement and structure of these prior art component interconnections limit the ability of end users to make such accuracy adjustments. For instance, fixity of prior art setups restricts the ability to tune an arrow's FOCB and frustrate selective clocking thereof.

Moreover, undermining the repeatability of clocking can be a severe disadvantage since clocking is a matter of personal preference, which archers developed over years of trial and error. And so, if an archer buys a first dozen of prior art arrows and from that first dozen defines the ideal clocking orientation, and subsequently buys a second dozen arrows, that archer is mostly likely going to have to spend additional time experimenting to find a new clocking orientation that produces the desired results. This can be time-consuming, because clocking in the prior art requires the user to remove and reorient an outsert and/or an insert to obtain consistent clocking each time a broadhead is replaced. Furthermore, the differing male thread end points and overall length may contribute to this problem as these are two factors that are out of the control of the end user, as mentioned above.

In sum, current arrow designs introduce a factor of eccentricity with each component, and connect the broadhead to the arrow shaft in a manner that frustrates custom tuning of the user's arrow spine stiffness, the arrow's FOCB, and the selective clocking of the broadhead blades relative to the vanes of the arrow shaft, all of which play an important role in arrow accuracy and end user satisfaction.

Accordingly, there is a need for arrow systems that diminish the number of components through a broadhead to arrow shaft connection less prone to eccentricity and facilitates end user in making accuracy adjustments improvements.

A first embodiment of the present invention provides a glue-in broadhead to arrow shaft connection, eliminating the threading along the exterior of the broadhead shank and thus removing a source of intolerance and inconsistency among manufacturers. Another advantage of a threadless shank is that it snugly, concentrically fits into the inner circumference of the arrow shaft, increasing accuracy. Furthermore, this glue-in configuration does not require an outsert or collar for attachment to the arrow shaft, thereby eliminating a component susceptible to inconsistent manufacture and as well as adding structure that can increase turbulence, drag and misalignments. This first embodiment still enables the addition of weights—through internal threaded weights along an inner portion of the shank—thereby still facilitating the accuracy adjustments of spine stiffness and FOCB.

Another arrow system of the present invention provides a screw-over broadhead to arrow shaft connection. In this embodiment, the shank of the broadhead has female threading along an inner circumference that mates with external male threading of a distal end of an insert. The proximal end of the insert provides internal threading for selectively adding weight. The proximal end of the insert mounts to the inner circumference of the arrow shaft. This screw-over broadhead configuration is a modular system enabling readily moving between a plurality of different broadheads and thus facilitating selectively choosing between as many different target point configurations through reliance of a consistent clocking of the broadhead blades.

The insert fits snugly into the arrow shaft for maximum accuracy and provides a male thread with a boss feature 51 to accurately locate the slot 49 on the broadhead for the blade clocking. Again, the screw-over configuration allows for selectively adjusting the target point configurations through enabling interchangeability. Specifically, the screw-over configuration allows end users to put on different broadhead types and sizes all having the same shank screw-over configuration. Each of these different types of broadheads—i.e., different target point configurations—allows for arguably the same clocking, facilitating repeatability and thus efficiency when interchanging among different types of broadheads.

SUMMARY OF THE INVENTION

In one aspect of the present invention, a micro-diameter arrow system provides an externally threadless broadhead shank dimensioned to snugly slide into a lumen of an arrow shaft.

In another aspect of the present invention, the micro-diameter arrow system includes wherein an operable length of the externally threadless broadhead shank has a uniform cross-section, wherein an inner circumference has cross-section that is generally coextensive with the uniform cross-section of the externally threadless broadhead shank for a distance equal or greater than said operable length, wherein an inner diameter of the lumen is one-half an inch or less, and as a corollary so is the uniform cross-section of the shank.

In yet another aspect of the present invention, an arrow system includes the following: a broadhead; an insert; and an arrow shaft, wherein a proximal end of the broadhead has internal female threading, wherein a distal end of the insert has external male threading operatively associative with the internal female threading, and wherein a proximal end of the insert is dimensioned to snugly slide into a lumen of the arrow shaft.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides an arrow system embodying a glue-in configuration or screw-over configuration of broadhead to arrow shaft connection. The glue-in configuration provides an externally threadless broadhead shank for slidably reception into the complementary and cross-sectionally coextensive lumen of the arrow shaft. The screw-over configuration provides a broadhead with female internal threading that operatively associates with male threading of an insert that interconnects the broadhead to the lumen of the arrow shaft.

Referring to FIGS. 2A through 4D, the present invention provides arrow systems adapted to optimize concentricity between broadhead 10 and arrow shaft 30 through improvements in the broadhead-arrow shaft interface. The broadhead-arrow shaft interface may be a glue-in configuration and, in another embodiment, may be a screw-over configuration.

Figure 1A:
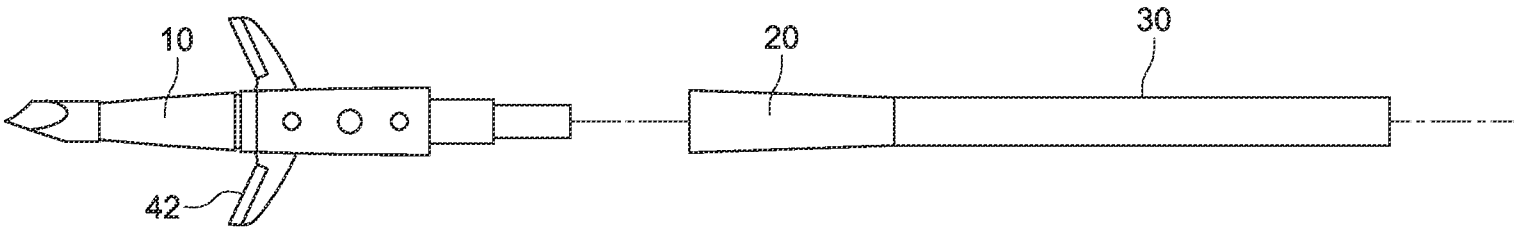
FIG. 1A (PRIOR ART)
FIG. 1A is an exploded elevation view of the prior art.
Figure 1B:
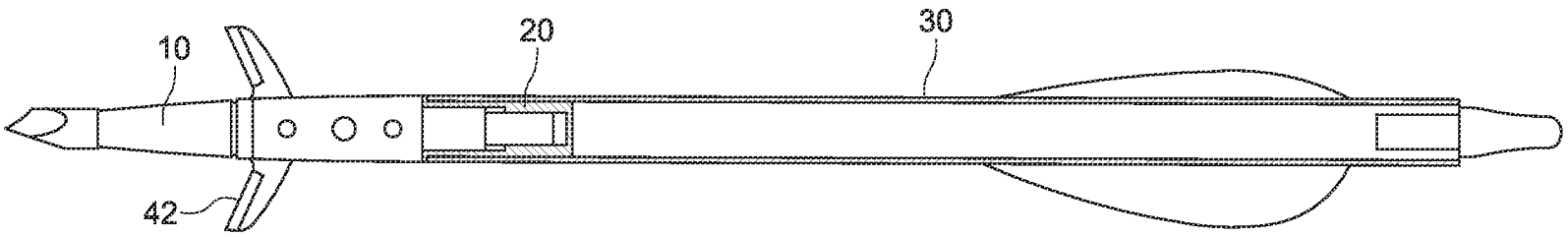
FIG. 1B (PRIOR ART)
FIG. 1B is an elevation view of the prior art.
Figure 2A:
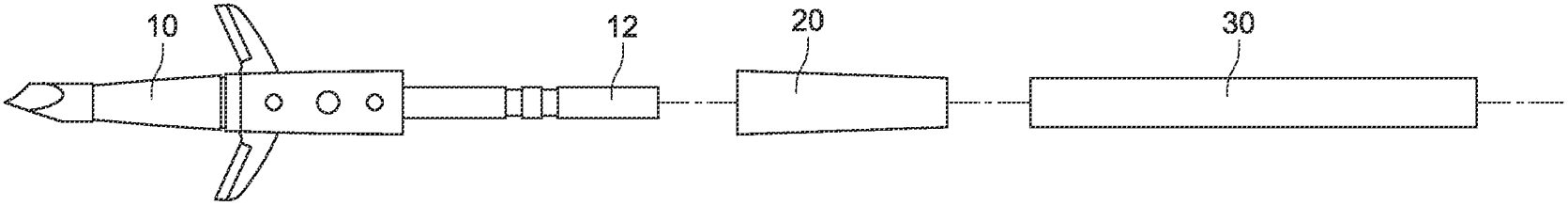
FIG. 2A is an exploded elevation view of an exemplary first embodiment of the present invention.
Figure 2B:
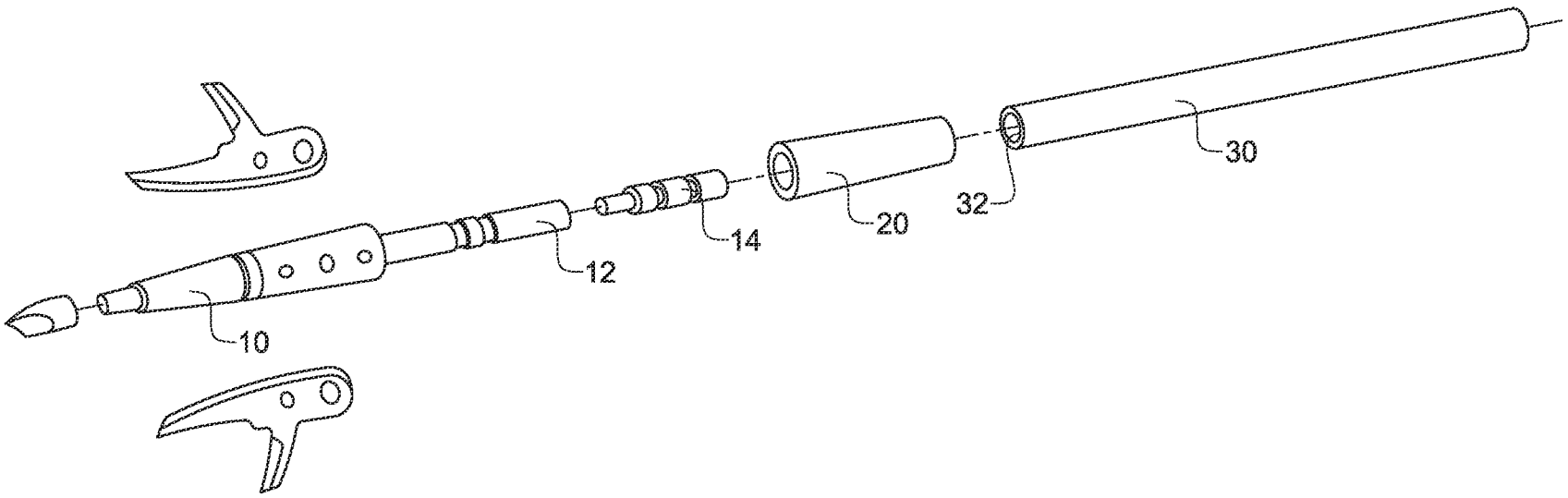
FIG. 2B is an exploded perspective view of an exemplary first embodiment of the present invention.

Referring to FIGS. 2A and 2B, the glue-in configuration includes broadhead 10 with an externally threadless shank 12. The externally threadless shank 12 may provide a uniform cross-section throughout its operable length (i.e., the length of the externally threadless shank 12 that interfaces with the arrow shaft 30). The externally threadless shank 12 may extend between one-half to one and one-half of an inch. The arrow shaft 30 is tubular, wherein the inner circumference or periphery of the lumen 32 of the arrow shaft 30 has a uniform cross section approximately coextensive with the external cross section of the threadless shank 12, facilitating a snug reception. Adhesive may be applied along the outer surface of the threadless shank 12, thereby further ensuring a tight, secure fitment between the threadless shank 12 and the inner circumference of the arrow shaft 30.

The externally threadless shank 12 may have internal threading for selectively receiving the threaded weights 14, as illustrated in FIG. 2B. The glue-in configuration may include an optional intermediate collar 20 into which the externally threadless shank 12 is slid, as opposed to the lumen 32 of the arrow shaft 30. The opposing end of the collar 20 may slide over the arrow shaft 30. Again, the collar 20 is optional as the glue-in configuration can directly connect the broadhead shank into the lumen on the arrow shaft 30.

Figure 3A:
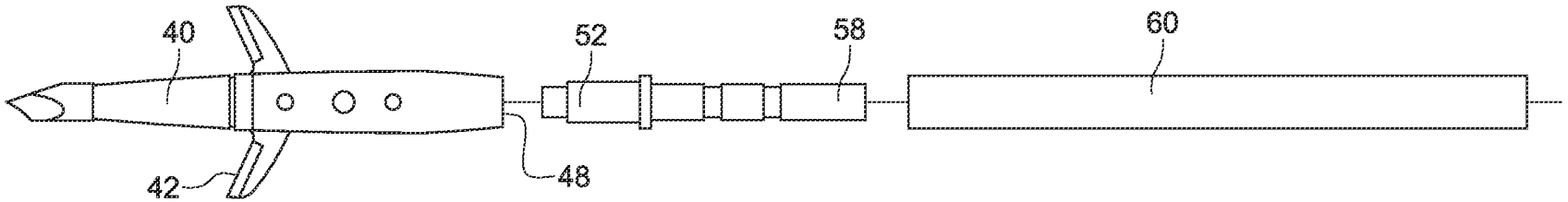
FIG. 3A is an exploded elevation view of an exemplary second embodiment of the present invention.
Figure 3B:
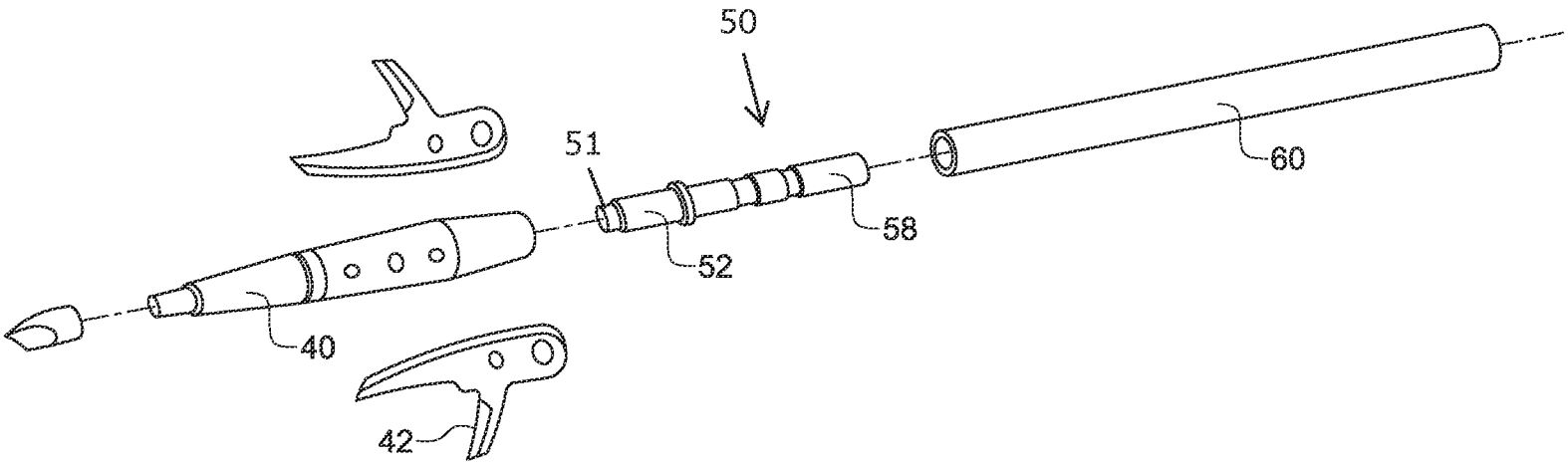
FIG. 3B is an exploded perspective view of an exemplary second embodiment of the present invention.
Figure 3C:
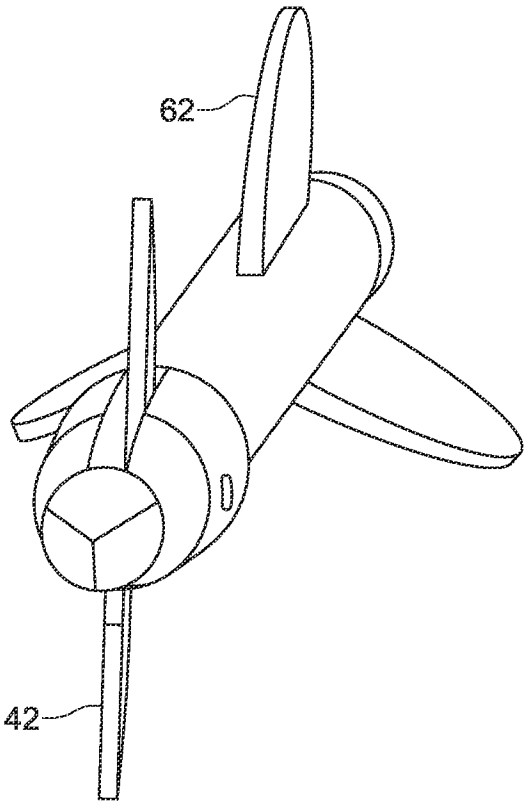
FIG. 3C is a perspective view of an exemplary second embodiment of the present invention, demonstrating one broadhead blade configuration of a plurality of a broadhead blade configurations.
Figure 4A:
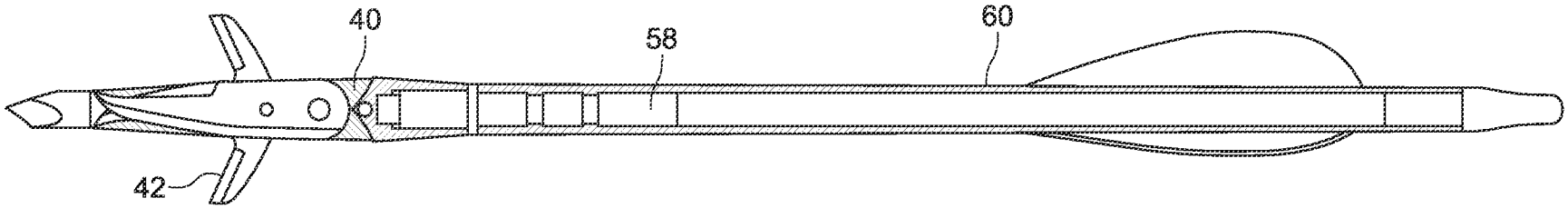
FIG. 4A is a section side elevation view of an exemplary second embodiment of the present invention, illustrating the insert 58, shown in use.
Figure 4B:
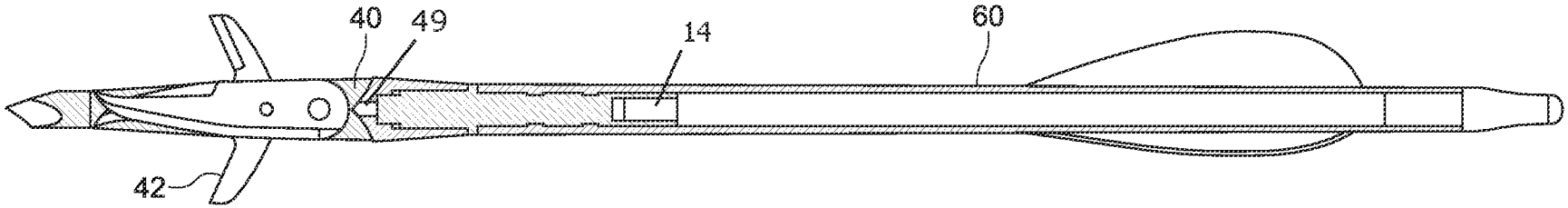
FIG. 4B is a section side elevation view of an exemplary second embodiment of the present invention, illustrating the threaded weight 14 of the insert 58, shown in use.
Figure 4C:
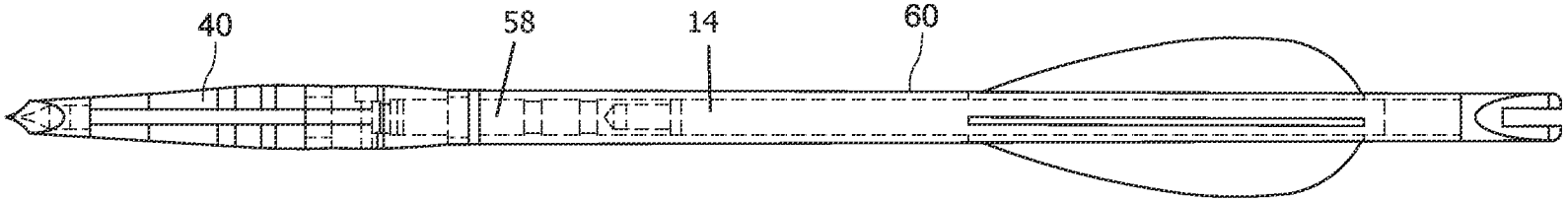
FIG. 4C is a side elevation view of an exemplary second embodiment of the present invention, using dashed lines to show the insert 58 and the threaded weight 14 in use.
Figure 4D:
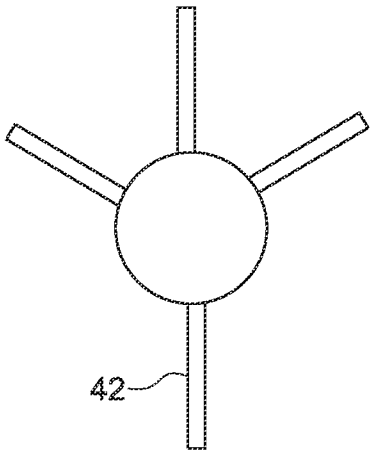
FIG. 4D is a front elevation view of an exemplary embodiment of the present invention.

Referring to FIGS. 3A through 3C, the screw-over configuration includes a broadhead 40, an insert 50 and an arrow shaft 60. The broadhead 40 has an open proximal end 48 that communicates with a hollow having internal female threading along an inner circumference thereof. A distal end 52 of the insert 50 has external male threading complementary of the internal female threading of the open proximal end 48 of the broadhead 40. The proximal portion 58 of the insert 50 has internal threading for selectively receiving threaded weights 14. The proximal portion 58 is dimensioned and adapted to be slidably received in the inner circumference of the arrow shaft 60, thereby affording the advantages of eliminating a collar as well as enabling a snug fitment that promotes concentricity.

The screw-over configuration, with the female threading of the open proximal end 48, facilitates clocking of the broadhead blades 42 relative to the vanes 62 of the arrow shaft 60 in a repeatably manner irrespective of the size and shape of the remaining portion of the broadhead 40. Thereby enabling inherent modularity of different types and styles of broadheads blades 42 to the same insert 50, thus the ability of the end user to readily and repeatedly transition among a plurality of target point configurations for different situations.

As used in this application, the term "about" or "approximately" refers to a range of values within plus or minus 10% of the specified number. And the term "substantially" refers to up to 90% or more of an entirety. Recitation of ranges of values herein are not intended to be limiting, referring instead individually to any and all values falling within the range, unless otherwise indicated, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described embodiments. The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. An arrow system comprising:

a broadhead;

an insert;

an arrow shaft defining a lumen having a slot associated with the broadhead, wherein a proximal end of the broadhead has internal female threading, wherein a distal end of the insert has external male threading operatively associative with the internal female threading, and wherein a proximal end of the insert is dimensioned to snugly slide into the lumen; and a boss feature directly connected to a terminus of said distal end of the insert so that the boss feature locates said slot when the insert is snugly slid in the lumen.

2. The arrow system of claim 1, wherein the boss feature has an outer diameter substantially less than a diameter of the distal end of the insert.

* * * * *